United States Patent [19]

Brosnan

[11] Patent Number: 4,947,712

[45] Date of Patent: Aug. 14, 1990

[54] SOCKET DEVICE

[76] Inventor: Robert C. Brosnan, 15516 Wenhaven Dr., Chagrin Falls, Ohio 44022

[21] Appl. No.: 240,958

[22] Filed: Sep. 6, 1988

Related U.S. Application Data

[63] Continuation-in-part of Ser. No. 137,072, Dec. 23, 1987, abandoned.

[51] Int. Cl.[5] ..... B25B 13/50

[52] U.S. Cl. ..... 81/53.2

[58] Field of Search ..... 81/53.2, 121.1, 120, 81/441, 125, 176.1, 176.15, 176.2

[56] References Cited

U.S. PATENT DOCUMENTS

| | | | |
|---|---|---|---|
| 1,458,956 | 6/1923 | Sayer . | |
| 1,590,200 | 6/1926 | McGuckin . | |
| 1,798,944 | 3/1931 | Jackman . | |
| 3,121,355 | 2/1964 | Morel et al. . | |
| 3,161,090 | 12/1964 | McLellan . | |
| 3,620,106 | 11/1971 | Dixon . | |
| 3,678,789 | 7/1972 | Wilson . | |
| 3,747,442 | 7/1973 | Rausch . | |
| 3,885,480 | 5/1975 | Muenchinger . | |
| 3,903,764 | 9/1975 | Andersen . | |
| 4,192,205 | 3/1980 | Dorosh | 81/53.2 |
| 4,607,547 | 8/1986 | Martus . | |
| 4,671,141 | 6/1987 | Hanson | 81/53.2 |

*Primary Examiner*—D. S. Meislin

*Attorney, Agent, or Firm*—Baldwin,Egan & Fetzer

[57] ABSTRACT

A wrench-type socket for removing bolts and the like whose head has become damaged or otherwise worn, thus prohibiting its removal by the use of a conventional socket. The present socket has an internal central cavity which is formed with at least one, but preferably a plurality, of elongated projections or shoulders which extend into said cavity, and which upon rotating the socket are intended to partially penetrate into the damaged bolt head and thus provide a driving connection therebetween to thereby provide torque to said bolt to thus cause its removal. If desired, the user may strike the means for rotating the socket to embed the projections or shoulders into the bolt head.

4 Claims, 1 Drawing Sheet

SOCKET DEVICE

This application is a continuation-in-part application of copending Ser. No. 07/137,072, filed Dec. 23, 1987 in the name of Robert C. Brosnan, now abandoned.

BACKGROUND OF THE INVENTION

This invention relates to a wrench-type socket especially designed to enable the removal of head-type bolts and the like wherein the bolt head is damaged or otherwise worn to a configuration which does not permit removal of said bolt by use of a conventional type of socket which has a socket configuration that closely matches or fits over the bolt head by which fit the conventional driving connection therebetween enables the bolt to be removed.

The socket of the present invention has a central cavity formed with at least one, but preferably a plurality, of elongated protuberances or projections which are intended to engage the bolt head, as the socket is rotated in the bolt withdrawal direction, thus providing a driving connection therebetween to cause the bolt to be rotated and removed.

SUMMARY OF THE INVENTION

The primary object of the present invention is to provide a new and improved wrench-type socket of novel but simpler construction than of previously designed sockets, which enables it to be manufactured substantially competitively with respect to said prior sockets.

Other objects and advantages of the present invention will be realized from the following description of a preferred embodiment thereof as illustrated in the drawings in which.

DESCRIPTION OF PREFERED EMBODIMENTS

Figure 1:
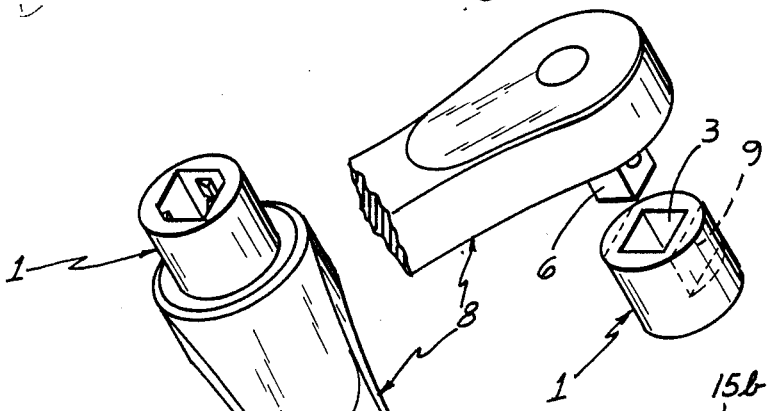
FIG. 1 is a partial perspective view of the socket of the present invention and a conventional ratchet wrench handle for use therewith to illustrate the environment of its intended use.
Figure 2:
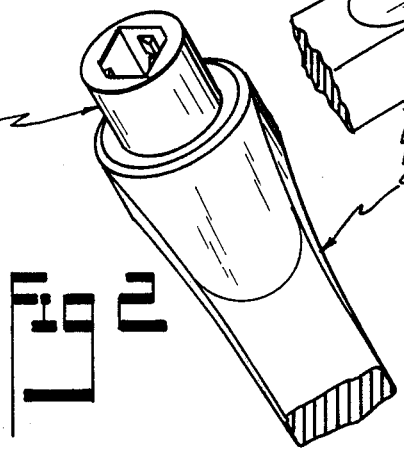
FIG. 2 is another partial perspective view of the socket wrench with the socket of the present invention shown attached to the ratchet handle and illustrating a portion of the construction of the socket.
Figure 7:
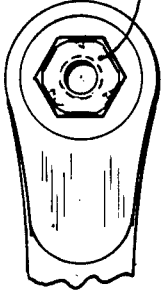
FIG. 7 is a view similar to FIG. 3, but illustrating the use of the socket of the present invention for removing a nut from its bolt or the like; and, FIG. 8 is an exploded view showing from left to right a typical nut intended for removal, the socket of the present invention and a portion of a typical ratchet handle for use therewith.

Referring now to FIG. 1, a socket 1 of the present invention as is depicted at 1 is cylindrical in external configuration and has a square recess 3 into which the driving stud 6 of a conventional ratchet-type wrench handle 8 is adapted to be inserted to drivingly connect the same together. As will be understood, the wrench handle 8 is intended to be rotated to thus rotate the socket 1 and thereby cause the removal of a bolt, nut or the like, the same being identified at b in FIGS. 3 and 5 and at n in FIGS. 7 and 8. As will be likewise understood, alternatively the socket 1 may be provided with opposed external flats as shown by dotted lines 9 upon which an open-end wrench (not shown) may be placed to provide for rotating socket 1.

Figure 5:
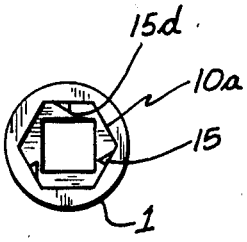
FIG. 5 is a view similar to FIG. 3 illustrating the driving connection between the socket projections and a square bolt head.
Figure 4:
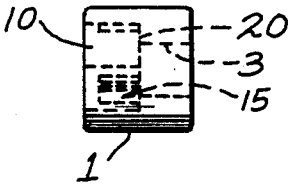
FIG. 4 is a side view of the socket of the present invention and illustrating the hidden or internal cavity formed therein.
Figure 6:
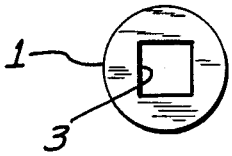
FIG. 6 is a top plan view of the socket illustrating the recess into which the driving stud of a ratchet wrench handle is intended to be inserted to interconnect said wrench handle to the socket.

As best seen in FIGS. 4 and 5, socket 1 is formed with an internal cavity or chamber 10 which extends partially centrally therethrough to connect at its inner end with one end of recess 3. In its present embodiment, cavity or chamber 10 is hex-shaped in cross-section, as that term is understood in the art, being formed with six flat walls **10*a* to readily accommodate a hex-shaped or square shaped bolt head h of bolt b. Alternatively, cavity 10** may be formed of other configurations such as cylindrical, octagonal or square by way of example, any one of said configurations being readily, easily and cheaply made by presently known methods such as milling or the like.

Figure 3:
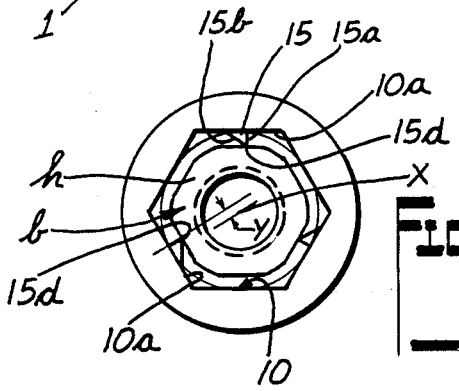
FIG. 3 is a view looking up into the cavity of the socket of the present invention illustrating the manner in which a damaged bolt head is engaged by the socket projections or protuberances.

A projection, or shoulder 15 is formed on three of the walls **10*a* and as seen in FIGS. 3 and 5 extend into cavity 10 toward the center thereof, being thus spaced apart 120° from each other. As seen in FIG. 3, each shoulder 15 is triangular in cross-section having surfaces 15*a* and 15*b* extending inwardly into cavity 10 from wall 10*a* converging toward each other to meet at a crest or peak 15*d*. As best seen in FIG. 3, the face 15*a* of each shoulder 15 is perpendicular to the surface of its associated wall 10*a*. The angular convergence of surfaces 15*a* and 15*b* of each shoulder is such as to position crest or peak 15*d* offset from the axis x of cavity 10 by the distance y. As will also be understood, with face 15*a* of shoulder 15 perpendicular to its surface 10*a*, for maximum torque between each said face 15*a* and the damaged bolt head, y should be reduced to zero so that the plane of each said face 15*a* passes through the axis or center of rotation x of the socket. With this offset relationship y (or when y is 0 resulting in no offset) as the socket 1 is rotated clockwise as viewed in FIGS. 3 and 7 to unscrew the bolt b or nut n, the crest or peak 15*d*** of each shoulder is forced into the bolt head h or nut n and provide a driving connection therebetween effective to rotate the said bolt or nut. The user, if desired, may strike the wrench handle to engage the shoulder and drive the crest into the bolt head or nut.

Figure 8:
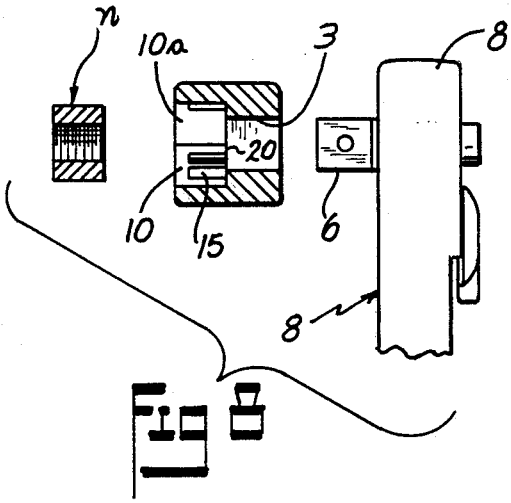

As best seen in FIGS. 4 and 8, shoulders 15 extend from wall 20 defining the inner end of cavity 10 longitudinally therethrough in parallel spaced relation to each other and terminate in close proximity to the opposite or open end of said cavity. With this construction, the crest **15*d*** of each shoulder engages the complete height of the bolt head h or nut n to thus provide a maximum crest surface to bolt or nut surface connection for effecting a driving connection therebetween.

Having thus described a preferred embodiment of wrench-type socket it will be apparent that the same is of novel but simpler construction that is readily capable of manufacture substantially competitively with previously known sockets.

I claim:

1. A socket for a socket-type wrench for removing damaged bolts or nuts comprising a tubular body having a continuous interior wall defining a chamber therein adapted to receive the head of a damaged bolt or nut, a recess in said body adapted to receive a driving means of a wrench to effect a driving connection therebetween, shoulder means comprising first and second walls formed integral at one end with the continuous wall, said first wall being perpendicular to said continuous wall and projecting into said chamber, said second wall projecting angularly from said continuous wall into said chamber and connecting at its inner end with the inner end of the first wall to form crest means fixed relative to said continuous wall, said crest means adapted to be releasably partially embedded into said bolt head or nut, wherein said wrench is rotated to rotate said socket in a direction to release said bolt or nut from its securing environment.

2. A socket as is defined in claim 1 and wherein there is a plurality of shoulder means equally spaced on said continuous wall.

3. A socket as is defined in claim 1 and wherein the first wall is offset with respect to the axis of the chamber.

4. A socket as defined in claim 1 and wherein the crest means on the shoulder means extends longitudinally through the chamber parallel with the axis thereof.

* * * * *